US012599220B2

(12) United States Patent
Burton

(10) Patent No.: US 12,599,220 B2
(45) Date of Patent: Apr. 14, 2026

(54) TOOTHPASTE AND TOOTHBRUSH HOLDER DEVICE

(71) Applicant: Annette Burton, Jonesboro, AR (US)

(72) Inventor: Annette Burton, Jonesboro, AR (US)

( * ) Notice: Subject to any disclaimer, the term of this patent is extended or adjusted under 35 U.S.C. 154(b) by 201 days.

(21) Appl. No.: 18/526,894

(22) Filed: Dec. 1, 2023

(65) Prior Publication Data

US 2025/0176698 A1 Jun. 5, 2025

(51) Int. Cl.

| | |
|---|---|
| ***A45D 44/18*** | (2006.01) |
| ***A45D 40/22*** | (2006.01) |
| ***A45D 40/26*** | (2006.01) |
| ***A46B 11/00*** | (2006.01) |

(52) U.S. Cl.

CPC ..... *A45D 44/18* (2013.01); *A45D 40/22* (2013.01); *A45D 40/26* (2013.01); *A46B 11/00* (2013.01); *A46B 11/0024* (2013.01)

(58) Field of Classification Search

CPC ..... A45D 44/18; A45D 40/22; A45D 40/26; A46B 11/00; A46B 11/002; A46B 11/0024; A46B 11/0027

USPC ..... 222/105, 106; 401/118, 123, 125, 155, 401/156, 158, 163, 164

See application file for complete search history.

(56) References Cited

U.S. PATENT DOCUMENTS

| | | | | |
|---|---|---|---|---|
| 1,644,049 | A * | 10/1927 | William | A47K 5/18 132/308 |
| 2,596,217 | A * | 5/1952 | Dendy | A46B 11/0006 222/230 |
| 4,056,110 | A * | 11/1977 | Landsman | A45D 44/18 401/129 |
| 5,244,298 | A * | 9/1993 | Greenhouse | A46B 11/0006 401/269 |
| D370,811 | S | 6/1996 | Stafford | |
| 5,871,124 | A | 2/1999 | Wilkinson | |
| 6,789,703 | B2 | 9/2004 | Pierre-Louis | |
| 8,523,472 | B2 | 9/2013 | JImenez | |
| 2009/0321477 | A1 | 12/2009 | Baca | |
| 2012/0222697 | A1 | 9/2012 | Schumann | |

FOREIGN PATENT DOCUMENTS

| | | |
|---|---|---|
| CA | 2513632 | 8/2004 |
| GB | 2336995 | 10/1999 |

* cited by examiner

*Primary Examiner* — David J Walczak

(57) ABSTRACT

A toothpaste and toothbrush holder device for storing and dispensing toothpaste includes a box that has a toothbrush chamber and a toothpaste chamber for storing a toothbrush and a tube of toothpaste. A pair of doors is each of the pair of doors is hingedly coupled to the box for opening or closing a respective toothbrush chamber or toothpaste chamber. A dispensing unit is movably integrated into the box and the dispensing unit is positioned in the toothpaste chamber to facilitate the dispensing unit to engage the tube of toothpaste. The dispensing unit is actuatable in a dispensing condition to urge toothpaste to flow outwardly from the tube of toothpaste.

11 Claims, 5 Drawing Sheets

TOOTHPASTE AND TOOTHBRUSH HOLDER DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to toothpaste holder devices and more particularly pertains to a new toothpaste holder device for storing and dispensing toothpaste and storing a toothbrush. The device includes a box which has a toothbrush chamber and a toothpaste chamber which can each store a toothbrush and a tube of toothpaste. The device includes a dispensing unit movably integrated into the box which urges toothpaste out of the tube of toothpaste. Additionally, the device includes a pair of doors for opening or closing the toothbrush chamber and the toothpaste chamber.

(2) Description of Related Art Including Information Disclosed Under 37 CFR 1.97 and 1.98

The prior art relates to toothpaste holder devices including a variety of toothbrush holding devices that each includes a storage space for a toothbrush and a manually operated dispensing mechanism for dispensing toothpaste from a tube of toothpaste and a variety of toothbrush holding devices for holding and storing a toothbrush. In no instance does the prior art disclose a toothbrush and toothpaste storage device that has storage space for a toothbrush and storage space for a tube of toothpaste and an electronic dispensing unit for automatically dispensing toothpaste from the tube of toothpaste.

BRIEF SUMMARY OF THE INVENTION

An embodiment of the disclosure meets the needs presented above by generally comprising a box that has a toothbrush chamber and a toothpaste chamber for storing a toothbrush and a tube of toothpaste. A pair of doors is each of the pair of doors is hingedly coupled to the box for opening or closing a respective toothbrush chamber or toothpaste chamber. A dispensing unit is movably integrated into the box and the dispensing unit is positioned in the toothpaste chamber to facilitate the dispensing unit to engage the tube of toothpaste. The dispensing unit is actuatable in a dispensing condition to urge toothpaste to flow outwardly from the tube of toothpaste.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
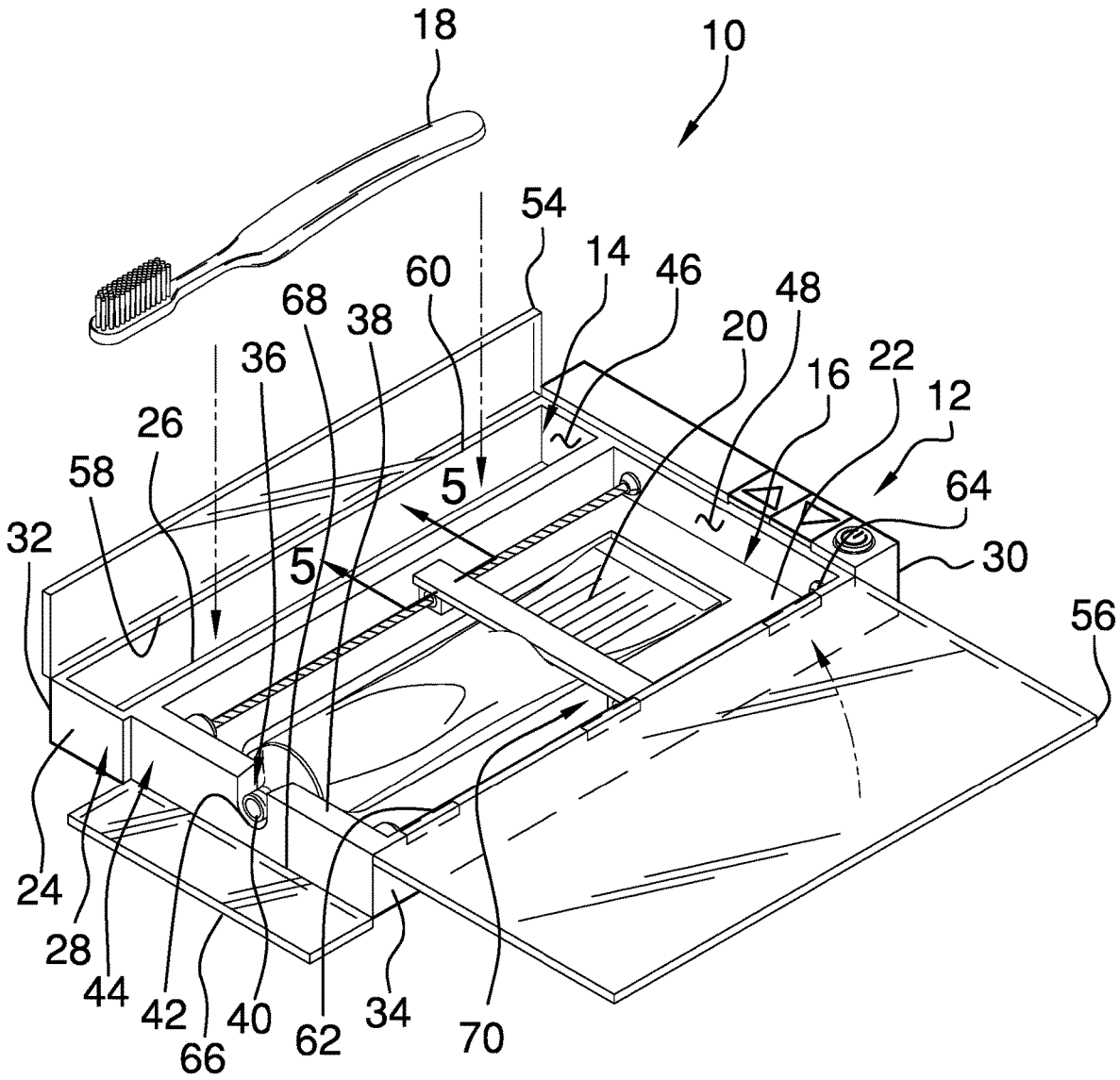
FIG. 1 is a top perspective view of a toothpaste and toothbrush holder device according to an embodiment of the disclosure.

With reference now to the drawings, and in particular to FIGS. 1 through 6 thereof, a new toothpaste holder device embodying the principles and concepts of an embodiment of the disclosure and generally designated by the reference numeral 10 will be described.

As best illustrated in FIGS. 1 through 6, the toothpaste and toothbrush holder device 10 generally comprises a box 12 has a toothbrush chamber 14 and a toothpaste chamber 16 that are each fluidly discrete from one another. The toothbrush chamber 14 can store a toothbrush 18 and the toothpaste chamber 16 can store a tube of toothpaste 20. The box 12 has a bottom wall 22 and a perimeter wall 24 extending upwardly from the bottom wall 22. The box 12 has a dividing wall 26 extending upwardly from the bottom wall 22 and extending between each of a front side 28 and a back side 30 of the perimeter wall 24. In this way the toothbrush chamber 14 is defined between the dividing wall 26 and a first lateral side 32 of the perimeter wall 24 and the toothpaste chamber 16 is defined between the dividing wall 26 and a second lateral side 34 of the perimeter wall 24. Furthermore, the dividing wall 26 is positioned closer to the first lateral side 32 than the second lateral side 34 such that the toothpaste chamber 16 has a width is greater than a width of the toothbrush chamber 14.

The front side 28 has a notch 36 extending downwardly from a top edge 38 of the front side 28 toward the bottom wall 22 to accommodate a nozzle 40 of the tube of toothpaste 20 when the tube of toothpaste 20 is positioned in the toothpaste chamber 16. The notch 36 is centrally positioned between the second lateral side 34 of the perimeter wall 24 and the dividing wall 26. Additionally, the notch 36 has a lower bounding surface 42 that is concavely arcuate with respect to the top edge 38 of the front side 28 to conform to curvature of the nozzle 40. The front side 28 has a recess 44 extending from the second lateral side 34 toward the first lateral side 32. Each of a rear bounding surface 46 of the toothbrush chamber 14 and a rear bounding surface 48 of the toothpaste chamber 16 is spaced from the back side 30 of the perimeter wall 24 such that a control surface 50 is defined which extends between the back side 30 and each of the rear bounding surface 46 of the toothbrush chamber 14 and the rear bounding surface 48 of the toothpaste chamber 16.

A pair of doors 52 is provided and each of the pair of doors 52 is hingedly coupled to the box 12. Each of the pair of doors 52 is aligned with a respective one of the toothbrush chamber 14 and the toothpaste chamber 16 for opening or closing the respective toothbrush chamber 14 or toothpaste chamber 16. The pair of doors 52 includes a first door 54 and a second door 56; the first door 54 has a coupled edge 58 hingedly coupled to a top edge 60 of the first lateral side 32 of the perimeter wall 24 of the box 12 and the second door 56 has a coupled edge 62 hingedly coupled to a top edge 64 of the second lateral side 34 of the perimeter wall 24 of the box 12. Each of the doors 52 may be comprised of a translucent material, including but not being limited to tempered glass or polycarbonate, to facilitate light to pass through the doors 52.

A front door 66 is included which has a lower edge 68 that is hingedly coupled to an intersection between the bottom wall 22 of the box 12 and the front side 28 of the perimeter wall 24 of the box 12. The front door 66 is aligned with the recess 44 in the front side 28 such that the front door 66 lies in the recess 44 when the front door 66 is closed. In this way the front door 66 covers the nozzle 40 of the tube of toothpaste 20 when the front door 66 is closed. Conversely, the recess 44 is exposed when the front door 66 is opened. The front door 66 is comprised of a translucent material, including but not being limited to tempered glass or polycarbonate, to facilitate light to pass through the doors 52.

A dispensing unit 70 is provided and the dispensing unit 70 is movably integrated into the box 12. The dispensing unit 70 is positioned in the toothpaste chamber 16 and the dispensing unit 70 engages the tube of toothpaste 20. The dispensing unit 70 is actuatable in a dispensing condition having the dispensing unit 70 travelling in a dispensing direction in the toothpaste chamber 16. In this way the dispensing unit 70 can urge toothpaste 72 to flow outwardly from the tube of toothpaste 20.

The dispensing unit 70 comprises a pair of motors 74 and each of the pair of motors 74 is attached to front bounding surface 75 of the toothpaste chamber 16. Each of the pair of motors 74 is spaced from a respective one of the dividing wall 26 and the second lateral side 34 of the perimeter wall 24 of the box 12. Additionally, each of the pair of motors 74 is actuatable to rotate in a first direction or a second direction. Each of the pair of motors 74 may comprise a two direction electric motor or the like.

The dispensing unit 70 includes a pair of screws 76 and each of the screws 76 has a first end 78 that is attached to an output 80 of a respective one of the pair of motors 74. Each of the pair of screws 76 is twisted in a primary direction when the pair of motors 74 is actuated to rotate in the first direction. Each of the pair of screws 76 is twisted in a secondary direction when the pair of motors 74 is actuated to rotate in the second direction. Additionally, each of the screws 76 may comprise a worm gear or other type of threaded shaft. The dispensing unit 70 includes a pair of bearings 82 each attached to the rear bounding surface 48 of the toothpaste chamber 16. Each of the bearings 82 is aligned with a respective one of the pair of motors 74 and a second end 84 of a respective one of the pair of screws 76 is rotatably attached to a respective one of the pair of bearings 82.

The dispensing unit 70 includes a member 86 that has a pair of blocks 88 each extending downwardly from the member 86. Each of the pair of blocks 88 is positioned adjacent to opposing ends of the member 86 with respect to each other. The dispensing unit 70 includes a pair of sleeves 90 and each of the pair of sleeves 90 extends through a respective one of the pair of blocks 88 on the member 86. Each of the pair of sleeves 90 has an inside bounding surface 92 that is threaded and each the pair of sleeves 90 is oriented to extend between a front side 94 and a back side 96 of the respective block 88.

Each of the pair of screws 76 extends through a respective one of the pair of sleeves 90 having each of the screws 76 threadably engaging the inside bounding surface 92 of the respective sleeve 90. In this way the member 86 is spaced from the bottom wall 22 of the box 12 to compress the tube of toothpaste 20 between the member 86 and the bottom wall 22. The member 86 travels toward the front bounding surface 75 of the toothpaste chamber 16 when the pair of motors 74 is actuated to rotate in the first direction. In this way the member 86 urges the toothpaste 72 to flow outwardly from the nozzle 40 in the tube of toothpaste 20. The member 86 travels toward the rear bounding surface 48 of the toothpaste chamber 16 when the pair of motors 74 is actuated to rotate in the second direction. In this way the member 86 facilitates the tube of toothpaste 20 to be removed from the toothpaste chamber 16 when the tube of toothpaste 20 is depleted of toothpaste 72.

The dispensing unit 70 includes a forward button 98 that is movably positioned on the control surface 50 defined on the box 12. The forward button 98 is electrically coupled to each of the pair of motors 74 and each of the pair of motors 74 is actuated to rotate in the first direction when the forward button 98 is depressed. The dispensing unit 70 includes a rear button 100 that is movably positioned on the control surface 50 defined on the box 12. The rear button 100 is electrically coupled to each of the pair of motors 74 and each of the pair of motors 74 is actuated to rotate in the second direction when the rear button 100 is depressed.

A power supply 102 is integrated into the box 12 and the power supply 102 is electrically coupled to each of the pair of motors 74. The power supply 102 comprises at least one battery 104 that is integrated into the box 12 and the at least one battery 104 is electrically coupled to each of the pair of motors 74. The power supply 102 includes a power button 106 that is movably positioned on the control surface 50 defined on the box 12 and the power button 106 is electrically coupled to each of the pair of motors 74. The power button 106 actuates each of the pair of motors 74 when the power button 106 is depressed into an on position. Conversely, the power button 106 de-actuates each of the pair of motors 74 when the power button 106 is biased into an off position.

Figure 2:
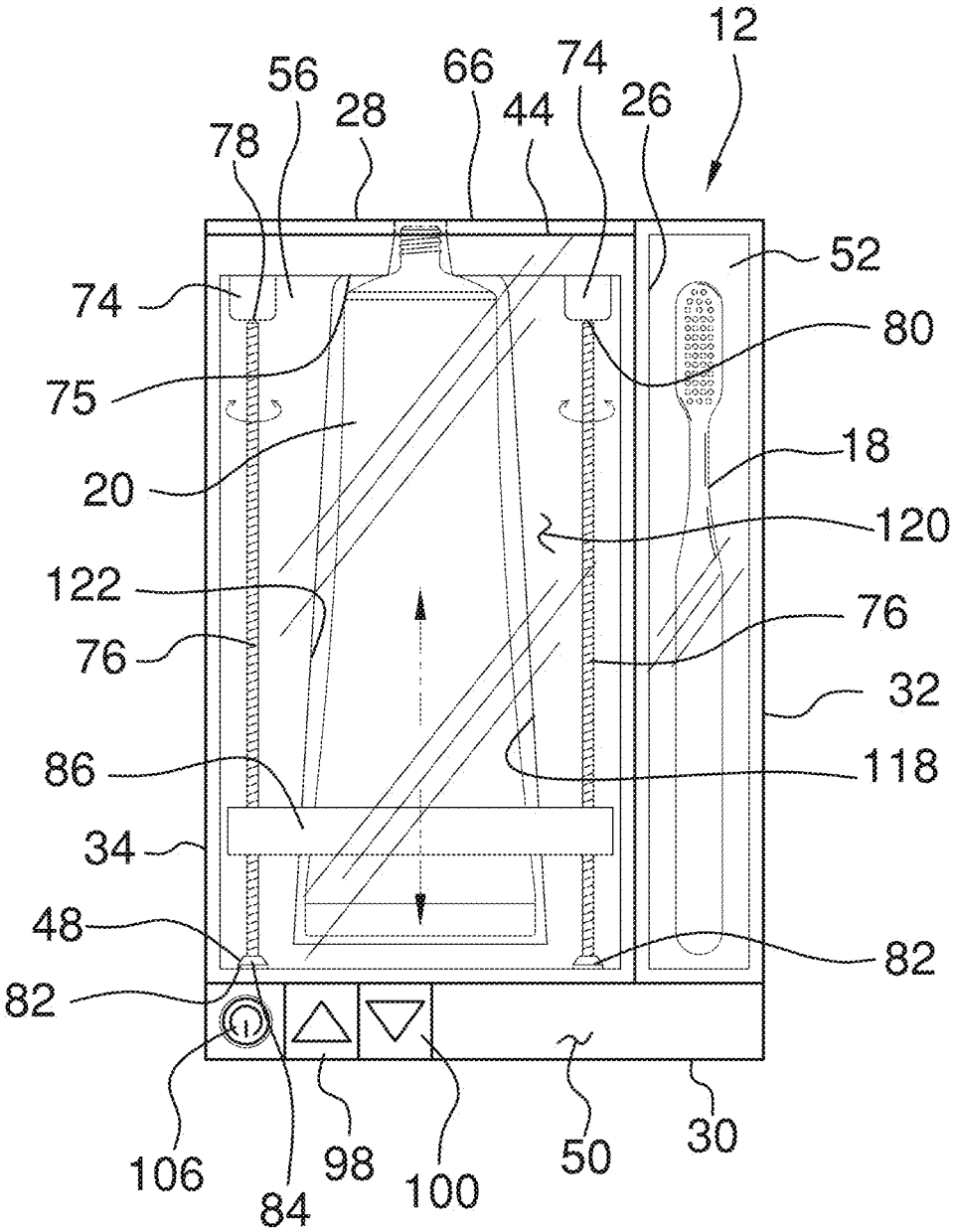
FIG. 2 is a top view of an embodiment of the disclosure.
Figure 3:
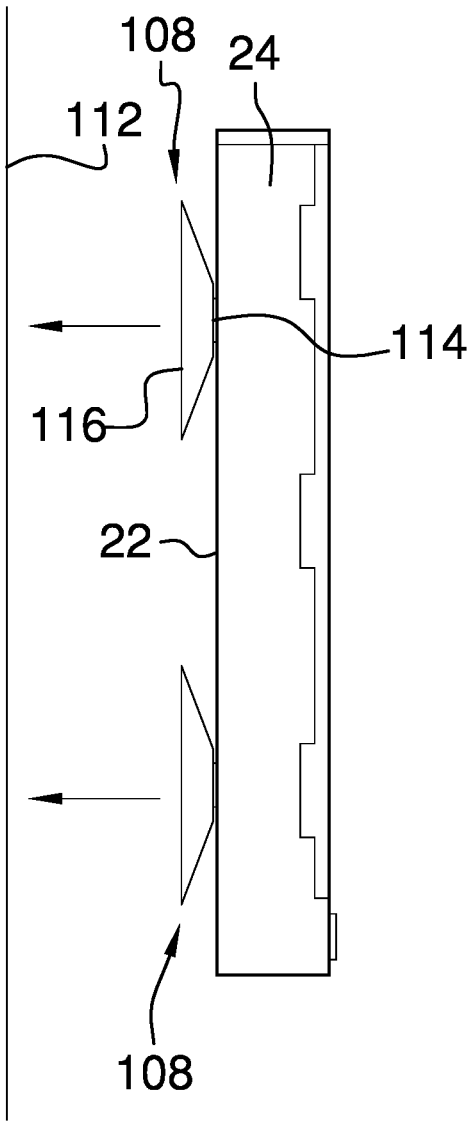
FIG. 3 is a right side view of an embodiment of the disclosure.
Figure 4:
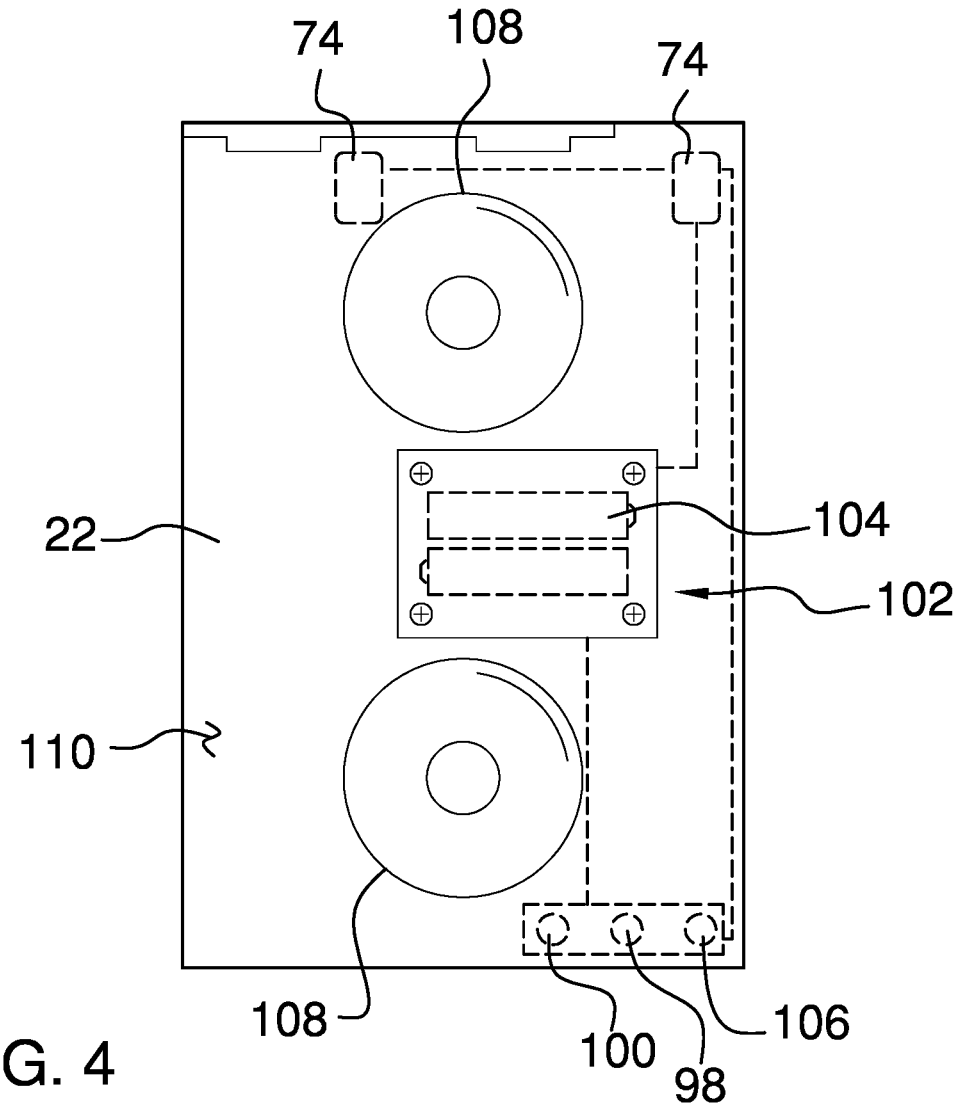
FIG. 4 is a back phantom view of an embodiment of the disclosure.
Figure 5:
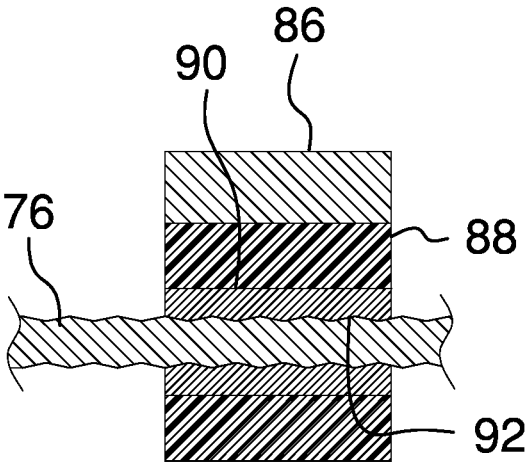
FIG. 5 is a cross sectional view taken along line 5-5 of FIG. 1 of an embodiment of the disclosure.
Figure 6:
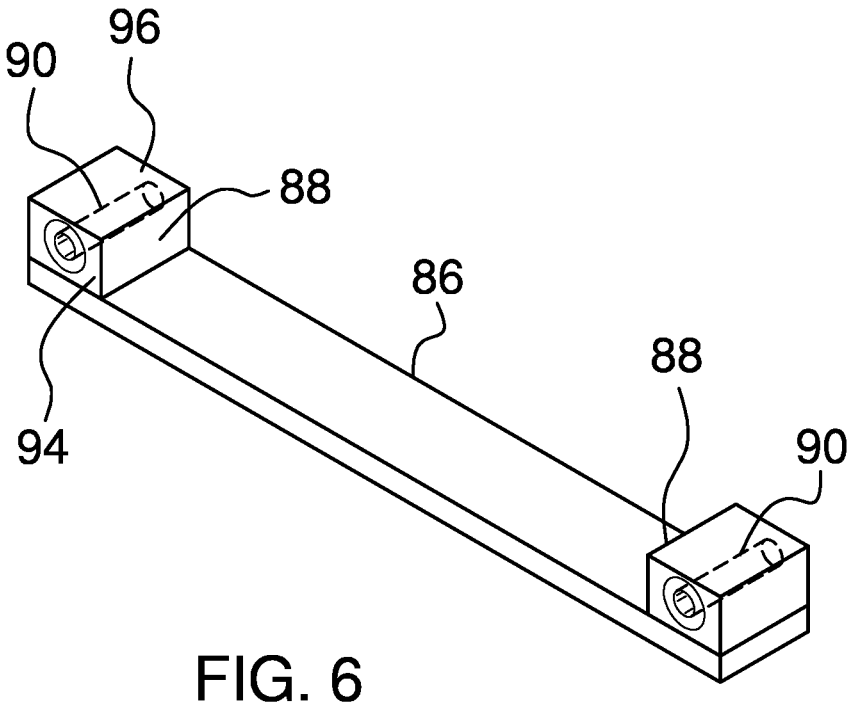
FIG. 6 is a bottom perspective view of a member and a pair of blocks of an embodiment of the disclosure.

A plurality of suction cups 108 is each attached to a lower surface 110 of the bottom wall 22 of the box 12. Each of the suction cups 108 can be compressed against a support surface 112, such as a mirror for example or other type of smooth and rigid surface. Each of the suction cups 108 flares outwardly between a coupled end 114 and a free end 116 of the suction cups 108 and each of the suction cups 108 is comprised of a deformable material. In this way the suction cups 108 suctionally engage the support surface 112 when the suction cups 108 are compressed against the support surface 112 for mounting the box 12 to the support surface 112. As is shown in FIGS. 1 and 2, a depression 118 extends downwardly into a top surface 120 of the bottom wall 22 of the box 12 and the depression 118 is located in the toothpaste chamber 16. The depression 118 has a bounding edge 122 which is contoured to accommodate the shape of the tube of toothpaste 20 for keeping the tube of toothpaste 20 in place while the member 86 urges toothpaste 72 out of the tube of toothpaste 20.

In use, the toothbrush 18 is stored in the toothbrush chamber 14 and the tube of toothpaste 20 is stored in the toothpaste chamber 16 such that the tube of toothpaste 20 is positioned between the member 86 and the bottom wall 22 of the box 12. In this way the toothbrush 18 and the tube of toothpaste 20 can be stored or transported in carryon luggage during air travel, for example. The front door 66 is opened and the forward button 98 is depressed for a sufficient duration of time to dispense a preferred amount of toothpaste 72 from the tube of toothpaste 20. In this way the toothpaste 72 can be dispensed onto the toothbrush 18 automatically. Furthermore, the front door 66 can be closed to inhibit the toothpaste 72 from escaping the box 12 and making a mess. The tube of toothpaste 20 can remain in the box 12 until the tube of toothpaste 20 is depleted and replaced with a new tube of toothpaste 20.

With respect to the above description then, it is to be realized that the optimum dimensional relationships for the parts of an embodiment enabled by the disclosure, to include variations in size, materials, shape, form, function and manner of operation, device and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A toothpaste and toothbrush holder device for storing a tube of toothpaste and a toothbrush and for releasing toothpaste from the tube of toothpaste, said device comprising:

a box having a toothbrush chamber and a toothpaste chamber each being fluidly discrete from one another wherein said toothbrush chamber is configured to store a toothbrush and wherein said toothpaste chamber is configured to store a tube of toothpaste;

a pair of doors, each of said pair of doors being hingedly coupled to said box, each of said pair of doors being aligned with a respective one of said toothbrush chamber and said toothpaste chamber for opening or closing said respective toothbrush chamber or toothpaste chamber;

a dispensing unit being movably integrated into said box, said dispensing unit being positioned in said toothpaste chamber wherein said dispensing unit is configured to engage the tube of toothpaste, said dispensing unit being actuatable in a dispensing condition having said dispensing unit travelling in a dispensing direction in said toothpaste chamber wherein said dispensing unit is configured to urge toothpaste to flow outwardly from the tube of toothpaste;

wherein said box has a bottom wall and a perimeter wall extending upwardly from said bottom wall; and wherein said box has a dividing wall extending upwardly from said bottom wall and extending between each of a front side and a back side of said perimeter wall thereby defining said toothbrush chamber between said dividing wall and a first lateral side of said perimeter wall and defining said toothpaste chamber between said dividing wall and a second lateral side of said perimeter wall;

said dividing wall is positioned closer to said first lateral side than said second lateral side such that said toothpaste chamber has a width being greater than a width of said toothbrush chamber;

said front side has a notch extending downwardly from a top edge of said front side toward said bottom wall wherein said notch is configured to accommodate a nozzle of the tube of toothpaste when the tube of toothpaste is positioned in said toothpaste chamber;

said notch is centrally positioned between said second lateral side of said perimeter wall and said dividing wall;

said notch has a lower bounding surface being concavely arcuate with respect to said top edge of said front side wherein said lower bounding surface is configured to conform to curvature of the nozzle;

said front side has a recess extending from said second lateral side toward said first lateral side; and each of a rear bounding surface of said toothbrush chamber and a rear bounding surface of said toothpaste chamber being spaced from said back side of said perimeter wall such that a control surface is defined which extends between said back side and each of said rear bounding surface of said toothbrush chamber and said rear bounding surface of said toothpaste chamber.

2. The device according to claim 1, wherein:

said pair of doors includes a first door and a second door;

said first door has a coupled edge being hingedly coupled to a top edge of said first lateral side of said perimeter wall of said box; and said second door has a coupled edge being hingedly coupled to a top edge of said second lateral side of said perimeter wall of said box.

3. The device according to claim 1, further comprising a front door having a lower edge being hingedly coupled to an intersection between said bottom wall of said box and said front side of said perimeter wall of said box, said front door being aligned with said recess in said front side such that said front door lies in said recess when said front door is closed wherein said front door is configured to cover the nozzle of the tube of toothpaste when said front door is closed, said recess being exposed when said front door is opened.

4. The device according to claim 1, wherein said dispensing unit comprises a pair of motors, each of said pair of motors being attached to front bounding surface of said toothpaste chamber, each of said pair of motors being spaced from a respective one of said dividing wall and said second lateral side of said perimeter wall of said box, each of said pair of motors being actuatable to rotate in a first direction or a second direction.

5. The device according to claim 4, wherein said dispensing unit includes a pair of screws, each of said screws having a first end being attached to an output of a respective one of said pair of motors, each of said pair of screws being twisted in a primary direction when said pair of motors is actuated to rotate in said first direction, each of said pair of screws being twisted in a secondary direction when said pair of motors is actuated to rotate in said second direction.

6. The device according to claim 5, wherein said dispensing unit includes a pair of bearings, each of said bearings being attached to said rear bounding surface of said toothpaste chamber, each of said bearings being aligned with a respective one of said pair of motors, a second end of a respective one of said pair of screws being rotatably attached to a respective one of said pair of bearings.

7. The device according to claim 5, wherein said dispensing unit includes:

a member having a pair of blocks each extending downwardly from said member, each of said pair of blocks being positioned adjacent to opposing ends of said member with respect to each other;

a pair of sleeves, each of said pair of sleeves extending through a respective one of said pair of blocks on said member, each of said pair of sleeves having an inside bounding surface being threaded, each said pair of sleeves being oriented to extend between a front side and a back side of said respective block; and each of said pair of screws extends through a respective one of said pair of sleeves having each of said screws threadably engaging said inside bounding surface of said respective sleeve such that said member is spaced from said bottom wall of said box wherein said member is configured to compress the tube of toothpaste between said member and said bottom wall.

8. The device according to claim 7, wherein:

said member travels toward said front bounding surface of said toothpaste chamber when said pair of motors is actuated to rotate in said first direction wherein said member is configured to urge the toothpaste to flow outwardly from the nozzle in the tube of toothpaste; and said member travels toward said rear bounding surface of said toothpaste chamber when said pair of motors is actuated to rotate in said second direction wherein said member is configured to facilitate the tube of toothpaste to be removed from said toothpaste chamber when the tube of toothpaste is depleted of toothpaste.

9. The device according to claim 4, wherein said dispensing unit includes:

a forward button being movably positioned on said control surface defined on said box, said forward button being electrically coupled to each of said pair of motors, each of said pair of motors being actuated to rotate in said first direction when said forward button is depressed; and a rear button being movably positioned on said control surface defined on said box, said rear button being electrically coupled to each of said pair of motors, each of said pair of motors being actuated to rotate in said second direction when said rear button is depressed.

10. The device according to claim 4, further comprising a power supply being integrated into said box, said power supply being electrically coupled to each of said pair of motors, said power supply comprising:

at least one battery being integrated into said box, said at least one battery being electrically coupled to each of said pair of motors; and a power button being movably positioned on said control surface defined on said box, said power button being electrically coupled to each of said pair of motors, said power button actuating each of said pair of motors when said power button is depressed into an on position, said power button de- actuating each of said pair of motors when said power button is biased into an off position.

11. A toothpaste and toothbrush holder device for storing a tube of toothpaste and a toothbrush and for releasing toothpaste from the tube of toothpaste, said device comprising:

a box having a toothbrush chamber and a toothpaste chamber each being fluidly discrete from one another wherein said toothbrush chamber is configured to store a toothbrush and wherein said toothpaste chamber is configured to store a tube of toothpaste, said box having a bottom wall and a perimeter wall extending upwardly from said bottom wall, said box having a dividing wall extending upwardly from said bottom wall and extending between each of a front side and a back side of said perimeter wall thereby defining said toothbrush chamber between said dividing wall and a first lateral side of said perimeter wall and defining said toothpaste chamber between said dividing wall and a second lateral side of said perimeter wall, said dividing wall being positioned closer to said first lateral side than said second lateral side such that said toothpaste chamber has a width being greater than a width of said toothbrush chamber, said front side having a notch extending downwardly from a top edge of said front side toward said bottom wall wherein said notch is configured to accommodate a nozzle of the tube of toothpaste when the tube of toothpaste is positioned in said toothpaste chamber, said notch being centrally positioned between said second lateral side of said perimeter wall and said dividing wall, said notch having a lower bounding surface being concavely arcuate with respect to said top edge of said front side wherein said lower bounding surface is configured to conform to curvature of the nozzle, said front side having a recess extending from said second lateral side toward said first lateral side, each of a rear bounding surface of said toothbrush chamber and a rear bounding surface of said toothpaste chamber being spaced from said back side of said perimeter wall such that a control surface is defined which extends between said back side and each of said rear bounding surface of said toothbrush chamber and said rear bounding surface of said toothpaste chamber;

a pair of doors, each of said pair of doors being hingedly coupled to said box, each of said pair of doors being aligned with a respective one of said toothbrush chamber and said toothpaste chamber for opening or closing said respective toothbrush chamber or toothpaste chamber, said pair of doors including a first door and a second door, said first door having a coupled edge being hingedly coupled to a top edge of said first lateral side of said perimeter wall of said box, said second door having a coupled edge being hingedly coupled to a top edge of said second lateral side of said perimeter wall of said box;

a front door having a lower edge being hingedly coupled to an intersection between said bottom wall of said box and said front side of said perimeter wall of said box, said front door being aligned with said recess in said front side such that said front door lies in said recess when said front door is closed wherein said front door is configured to cover the nozzle of the tube of toothpaste when said front door is closed, said recess being exposed when said front door is opened;

a dispensing unit being movably integrated into said box, said dispensing unit being positioned in said toothpaste chamber wherein said dispensing unit is configured to engage the tube of toothpaste, said dispensing unit being actuatable in a dispensing condition having said dispensing unit travelling in a dispensing direction in said toothpaste chamber wherein said dispensing unit is configured to urge toothpaste to flow outwardly from the tube of toothpaste, said dispensing unit comprising:

a pair of motors, each of said pair of motors being attached to front bounding surface of said toothpaste chamber, each of said pair of motors being spaced from a respective one of said dividing wall and said second lateral side of said perimeter wall of said box, each of said pair of motors being actuatable to rotate in a first direction or a second direction;

a pair of screws, each of said screws having a first end being attached to an output of a respective one of said pair of motors, each of said pair of screws being twisted in a primary direction when said pair of motors is actuated to rotate in said first direction, each of said pair of screws being twisted in a secondary direction when said pair of motors is actuated to rotate in said second direction;

a pair of bearings, each of said bearings being attached to said rear bounding surface of said toothpaste chamber, each of said bearings being aligned with a respective one of said pair of motors, a second end of a respective one of said pair of screws being rotatably attached to a respective one of said pair of bearings;

a member having a pair of blocks each extending downwardly from said member, each of said pair of blocks being positioned adjacent to opposing ends of said member with respect to each other;

a pair of sleeves, each of said pair of sleeves extending through a respective one of said pair of blocks on said member, each of said pair of sleeves having an inside bounding surface being threaded, each said pair of sleeves being oriented to extend between a front side and a back side of said respective block, each of said pair of screws extending through a respective one of said pair of sleeves having each of said screws threadably engaging said inside bounding surface of said respective sleeve such that said member is spaced from said bottom wall of said box wherein said member is configured to compress the tube of toothpaste between said member and said bottom wall, said member travelling toward said front bounding surface of said toothpaste chamber when said pair of motors is actuated to rotate in said first direction wherein said member is configured to urge the toothpaste to flow outwardly from the nozzle in the tube of toothpaste, said member travelling toward said rear bounding surface of said toothpaste chamber when said pair of motors is actuated to rotate in said second direction wherein said member is configured to facilitate the tube of toothpaste to be removed from said toothpaste chamber when the tube of toothpaste is depleted of toothpaste;

a forward button being movably positioned on said control surface defined on said box, said forward button being electrically coupled to each of said pair of motors, each of said pair of motors being actuated to rotate in said first direction when said forward button is depressed;

a rear button being movably positioned on said control surface defined on said box, said rear button being electrically coupled to each of said pair of motors, each of said pair of motors being actuated to rotate in said second direction when said rear button is depressed; and a power supply being integrated into said box, said power supply being electrically coupled to each of said pair of motors, said power supply comprising:

at least one battery being integrated into said box, said at least one battery being electrically coupled to each of said pair of motors; and a power button being movably positioned on said control surface defined on said box, said power button being electrically coupled to each of said pair of motors, said power button actuating each of said pair of motors when said power button is depressed into an on position, said power button de-actuating each of said pair of motors when said power button is biased into an off position.

* * * * *